United States Patent [19]

Fusco et al.

[11] 4,087,908

[45] May 9, 1978

[54] CONNECTOR HARNESS ASSEMBLY MACHINE

[75] Inventors: Vito A. Fusco, Palos Hills; Joseph C. Bennett, Lisle; Jack F. Funcik, Downers Grove; Kenneth L. Kufner, Hickory Hills; Thomas E. Schneider, Burbank, all of Ill.

[73] Assignee: Molex Incorporated, Lisle, Ill.

[21] Appl. No.: 770,853

[22] Filed: Feb. 22, 1977

Related U.S. Application Data

[62] Division of Ser. No. 659,004, Feb. 18, 1976, Pat. No. 4,055,889.

[51] Int. Cl.[2] ..... H01R 43/04

[52] U.S. Cl. ..... 29/753; 29/564.4; 29/759

[58] Field of Search ..... 29/753, 759, 564.4, 29/564.8, 564.1

[56] References Cited

U.S. PATENT DOCUMENTS

| | | | |
|---|---|---|---|
| 3,769,681 | 11/1973 | Eubanks | 29/564.4 |
| 3,800,389 | 4/1974 | Brehm et al. | 29/753 X |
| 3,964,147 | 6/1976 | Fusco et al. | 29/753 X |

*Primary Examiner*—Carl E. Hall

*Attorney, Agent, or Firm*—Louis A. Hecht

[57] ABSTRACT

A connector harness assembly machine which includes a wire preparation assembly for cutting and stripping a reel of wire to provide a plurality of unterminated cut and stripped wire leads of various lengths. The cut and stripped wire lead is then transported by means of a wire transport assembly to a plurality of stations comprising a wire termination assembly. The wire termination assembly includes a wire pickup station whereat the cut and stripped wire lead is picked up, an insulation strip test station including an insulation strip sensor to check whether insulation has been stripped from the wire, a crimp station including crimping means for crimping a terminal onto a wire lead, a terminal test station including a terminal sensor to determine whether a terminal has been properly crimped, a wire reject station including means for releasing an improperly prepared wire lead, and an insertion station where a terminated wire lead is inserted into a connector housing.

2 Claims, 29 Drawing Figures

CONNECTOR HARNESS ASSEMBLY MACHINE

This is a division of application Ser. No. 659,004 filed Feb. 18, 1976 now U.S. Pat. No. 4,055,889.

BACKGROUND OF THE INVENTION

1. Field of the Invention

The present invention relates to a connector harness assembly machine in general. In particular, the present invention relates to a wire handling and fabrication machine; a machine for automatically inserting terminated wire leads into a connector housing; and a connector harness assembly machine which both handles and fabricates the wire automatically, as well as automatically inserting a terminated wire lead into a connector housing.

2. Brief Description of the Prior Art

In today's ever-growing demand for electronics and, therefore, electrical connector assemblies, there is always a constant need for cutting costs regarding the use of such connectors. A connector assembly conventionally includes a connector housing made of insulated material having a plurality of terminal receiving cavities formed therein and a plurality of like terminals, each being receivable into its corresponding cavity. A plurality of stripped and cut insulation clad wires are adapted to be crimped onto the end of each terminal. It has been found that one of the largest cost factors in employing electrical connectors of this type is cost of assembling the connector.

The assembly process can be broken down into seven general categories:

1. Insulation clad wire, usually provided on a reel, must be cut to a predetermined length and the insulation must be stripped from one end thereof.

2. The cut and stripped wire then has a terminal crimped on the stripped end thereof. One of the problems in performing the crimping operation is to not only properly position a cut and stripped wire lead at a crimp station, but also to ensure that any resultant crimp is satisfactory.

3. Because the wire preparation steps and the wire termination steps are usually performed at two different locations, the cut and stripped wire lead has to be carried between these two locations.

4. The terminated wire lead must then be inserted into a connector housing.

5. There must be some assurance that the right terminated wire lead is inserted into a corresponding terminal receiving cavity of a connector housing.

6. The connector housings must be supplied to an operator performing the insertion operation.

7. The housing must be physically carried from wherever they are supplied to wherever the terminated wire leads are being inserted.

If all of the above operations were done manually, it is easy to see the relatively large expense invested in labor in order to use connector assemblies.

The general concept of automatically preparing a wire in a machine is already well known in the art and is embodied in U.S. Pat. No. 3,769,681, issued Nov. 6, 1973, and entitled "Apparatus for Attaching Terminals to Electric Conductors". The wire handling fabrication machine generally includes a wire preparation means for presenting an insulation clad wire lead that is cut and stripped in a predetermined manner at a pickup station, a crimp station which has a plurality of terminals and means for crimping a terminal onto a wire, a wire carrier for holding a wire, and intermittent drive means associated with the wire carrier for moving the wire between the stations.

The concept of automatically inserting a terminated wire lead is disclosed in U.S. Patent application Ser. No. 538,188, filed Jan. 2, 1975, now U.S. Pat. No. 3,964,147, and entitled "Connector Assembly Machine" and assigned to the assignee of the present invention. A connector harness assembly machine of the type disclosed, automatically inserts a plurality of terminated wire leads, one at a time, into a plurality of corresponding terminal receiving cavities formed in the connector housing.

The very broad concept of providing many of the steps as set forth above is disclosed in U.S. Pat. No. 3,766,624, issued Oct. 23, 1973, and entitled "Automatic Lead Making and Wiring Machine". However, the last mentioned patent does not disclose any specific means of effecting the required operations.

In short, no known prior art has effectively combined all seven operations as set forth above into an efficient, totally automatic machine.

SUMMARY OF THE INVENTION

It is therefore the principal object of the present invention to provide a completely automatic connector harness assembly machine that performs all the functions necessary to produce a plurality of completed connector harnesses with a high degree of reliability and quality.

One feature of the present invention is to provide an improved wire handling and fabrication machine of the type already described which results in a higher quality and quantity of wire lead terminations produced from a crimping means mounted at a crimp station. The improvement generally includes wire guide means at the crimp station having a slot open at the top to receive and align the wire lead at the crimp station. A wire carrier is pivotally mounted between a first position wherein a wire lead is in an upwardly slanted position over said slot and a second position wherein the wire lead is in a substantially horizontal position into said slot. Movable carrier deflector means is associated with the crimping means and is adapted to engage the wire carrier to move the wire carrier between its first position and its second position so that the wire lead is moved into and out of said slot.

Another feature of the present invention is to provide a wire handling and fabrication machine that includes an insulation strip test station intermediate a wire pickup station and the crimp station and including insulation strip sensing means for sensing whether a wire lead has been properly stripped of its insulation. The insulation strip sensing means is associated with the crimping means for deactivating the crimping means whenever an unstripped wire has been sensed.

Still another feature of the present invention is to provide a wire handling and fabrication machine with a terminal test station after the crimp station and including terminal sensing means for sensing whether a terminal has been properly crimped into a wire lead.

It is another feature of the present invention to provide an improved connector harness assembly machine which will result in a higher quality and quantity of completed connector harness assemblies. The machine includes a harness fabrication assembly with an insertion station. A harness test assembly is associated with the harness fabrication assembly for sensing whether a terminated wire lead has been properly received into its corresponding terminal receiving cavity and sorting the good connector harnesses from the bad connector harnesses.

It is another feature of the present invention to provide a connector harness assembly machine of the type described having an improved means of feeding and indexing housings to and from an insertion station. The improvement generally includes a housing feed assembly for feeding a plurality of housings, one at a time, to a housing load station spaced from the insertion station and a housing indexing assembly for holding and moving a housing relative to and between said insertion and housing load stations.

Still another feature of the present invention is to provide a connector harness assembly machine which automatically performs all the functions required to manufacture a completed electrical connector assembly. The connector harness assembly machine generally includes wire preparation means including at least one wire preparation station for producing terminated wire leads, one at a time, a harness fabrication assembly having an insertion station whereat the wire leads are inserted into downwardly facing cavities of a connector housing, and a wire transport assembly for moving the wire leads to the insertion station one at a time. The wire transport assembly includes a wire carrier for releasably holding a wire lead, means for pivotally mounting the wire carrier between an initial position wherein the wire lead is held in a generally horizontal disposition and an insertion position wherein the wire lead is held in a generally vertical dispostion. Cam means is provided to engage said wire carrier prior to reaching said insertion station for pivoting the wire carrier from its initial position to its insertion position.

DESCRIPTION OF THE PREFERRED EMBODIMENT

I. GENERAL

Figure 1:
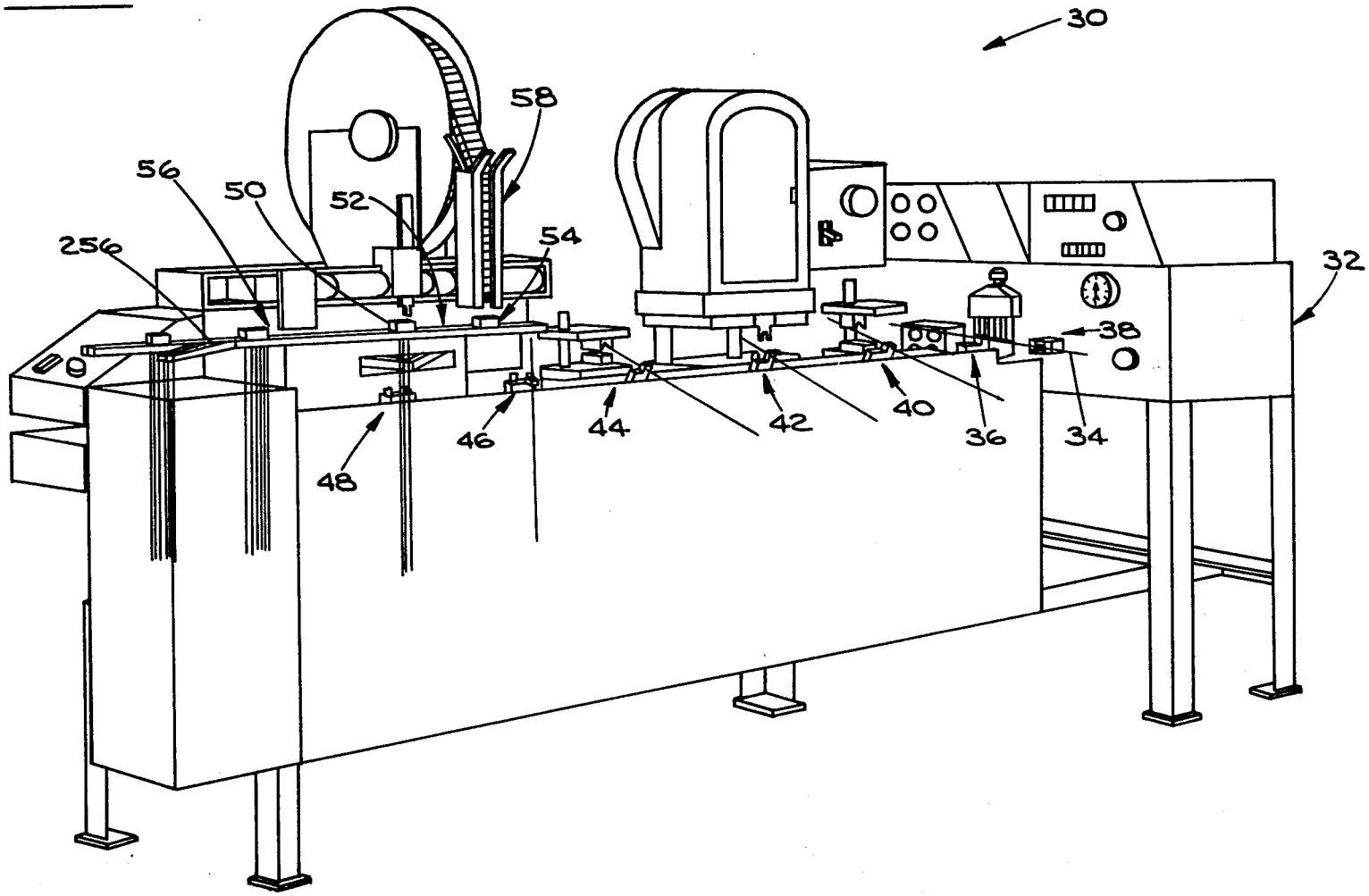
FIG. 1 is a perspective view of the connector harness assembly machine of the present invention.

Turning now to FIG. 1, the connector harness assembly machine of the present invention, generally designated 30, is illustrated. The machine 30 is designed to automatically prepare insulated wire to varying lengths, crimp a terminal to one end of these wires and assemble the terminated wire to a connector housing in a predetermined circuit arrangement.

The machine 30 is seen to generally include a wire preparation assembly or unit, generally designated 32. This unit 32 automatically feeds wire 34 from a continuous spool of wire (not shown), cuts the wire to predetermined varying lengths, strips both ends of the wire, and positions the wire for pickup.

A plurality of wire carriers, generally designated 36, which comprise part of a wire transport assembly, pick up the wire leads 34 from the wire preparation unit 32. The wire carrier 36 is then used to transport the wire lead 34 to a plurality of stations comprising a wire termination assembly wherein a terminal is crimped onto the cut and stripped wire lead 34.

The wire termination assembly stations include an initial wire pickup station, generally designated 38, wherein the wire carrier 36 picks up a cut and stripped wire lead 34 from the wire preparation unit 32. Then, in seriatim, the cut and stripped wire lead 34 is moved to an insulation strip test station, generally designed 40, a crimp station, generally designed 42, a terminal test station, generally designated 44, and a wire reject station, generally designated 46. The now terminated wire lead 34 is moved to an insertion station, generally designated 48, wherein said lead is inserted upwardly into a connector housing 50.

The harness is prepared by a harness fabrication assembly at the insertion station 48. The housing 50 is held and moved by a housing indexing assembly, generally designated 52. The housing indexing assembly moves connector housings 50 between and relative to a housing load station 54, insertion station 48, and an eject station, generally designated 56. A housing feed assembly, generally designated 58, is employed to feed a plurality of housings 50, one at a time, to the housing load station 54.

Figure 12:
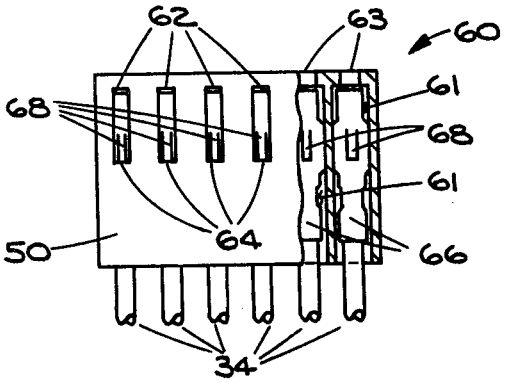
FIG. 12 is a fragmentary elevation of a completed connector harness assembly fabricated by the machine of the present invention.
Figure 21:
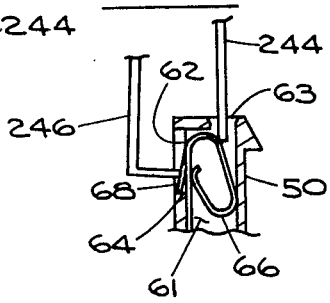
FIG. 21 is an enlarged fragmentary sectional view of the probe assembly and the terminal receiving cavity area as shown in FIG. 20.

As best shown in FIGS. 12 and 21, a completed connector harness 60 is formed by inserting terminated wire leads 34 into corresponding terminal receiving cavities 61 formed in the housing 50. Each cavity 61 has a slot 62 formed on one side and an opening 63 formed on the top allowing communication within the cavity. Each slot has a stop shoulder 64.

A terminal 66 is crimped onto the end of the wire lead 34 prior to insertion. The terminal 66 has a locking tang 68 which is intended to engage the shoulder 64 when the terminal is fully inserted.

II. WIRE PREPARATION ASSEMBLY

Turning now to FIGS. 4–8, the wire preparation assembly 32 will be discussed in greater detail.

Figure 4:
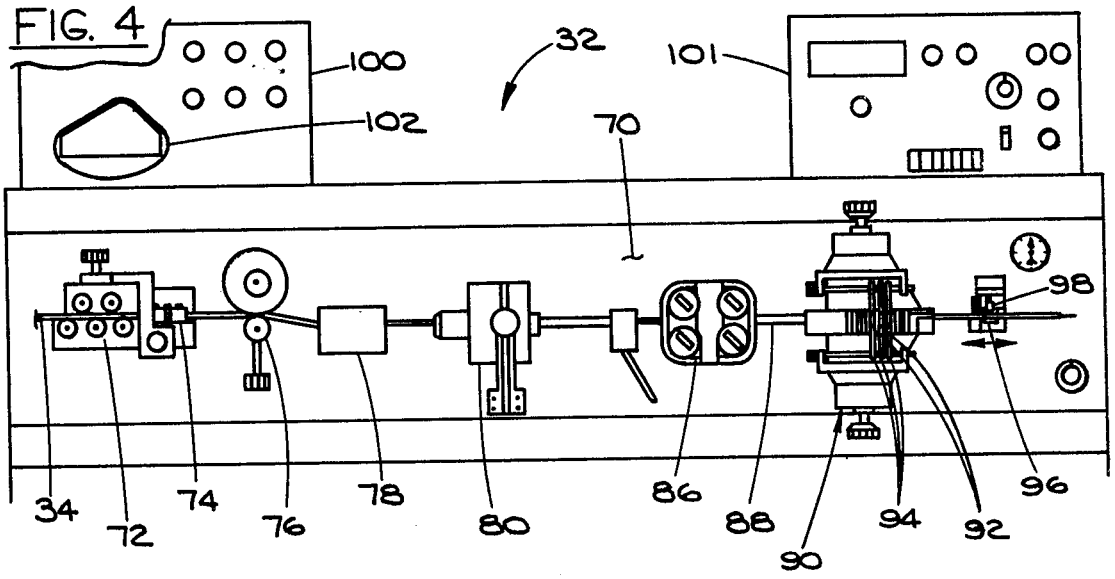
FIG. 4 is a front elevational fragmentary view of the wire preparation assembly of the machine of the present invention wherein wire cutting and stripping means is shown in one position.

Looking at FIG. 4, the wire preparation assembly 32 has a vertical front plate 70 having wire handling apparatus mounted thereon. Initially, the wire 34 is picked up off a reel (not shown) and fed through two sets of straightening rollers 72 and 74, and then a pair of length measurement rollers 76. Rollers 72 and 74 straighten the wire 34 in different axes. From the rollers 76, the wire 34 is fed through a wire guide 78 into a gripper-stripper mechanism 80 then to drive rollers 86 and a wire tube 88.

From the wire tube 88, the wire 34 is fed into a cutting and stripping mechanism, generally designated 90. This mechanism 90 cuts the wire to a predetermined length, then strips the insulation from the wire.

The cutting and stripping mechanism 90 is seen to generally include stationary blade guide plates having an opening 93 therethrough (FIG. 8) for guiding the wire 34. Pairs of movable cutting blades 94 are disposed on either side of the opening (not shown) and are adapted to fit between the blade guide plates 92. One cutting blade 94 serves to cut the wire 34 while the other cutting blade serves to cut the insulation a given distance from the end of the wire.

A gripping device comprising lower and upper gripping fingers, 96 and 98, respectively, is employed to grip the wire and move it from the cutting and stripping mechanism 90. The lower finger 96 is stationary and serves as a bottom support for the wire 34. The upper finger 98 is movable toward and away from the longer finger 96 in a gripping fashion.

Figure 5:
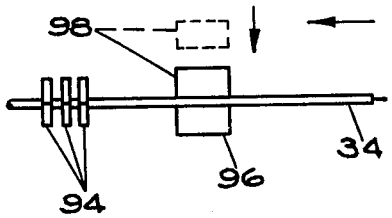
FIG. 5 is a front elevational schematic view of a portion of the wire preparation assembly wherein the wire cutting and stripping means is shown in a second position.
Figure 6:
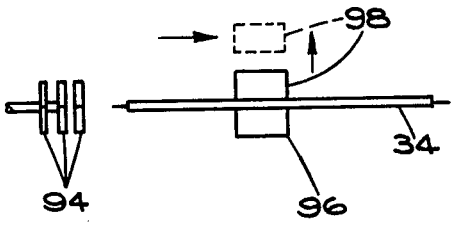
FIG. 6 is a front elevational schematic view of a portion of the wire preparation assembly wherein the wire cutting and stripping means is shown in a third position.
Figure 7:
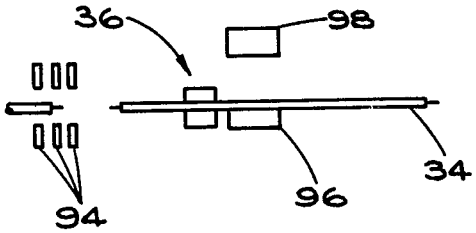
FIG. 7 is a front elevational schematic view of a portion of the wire preparation assembly and the wire carrier wherein the wire cutting and stripping means is shown in a fourth position.
Figure 8:
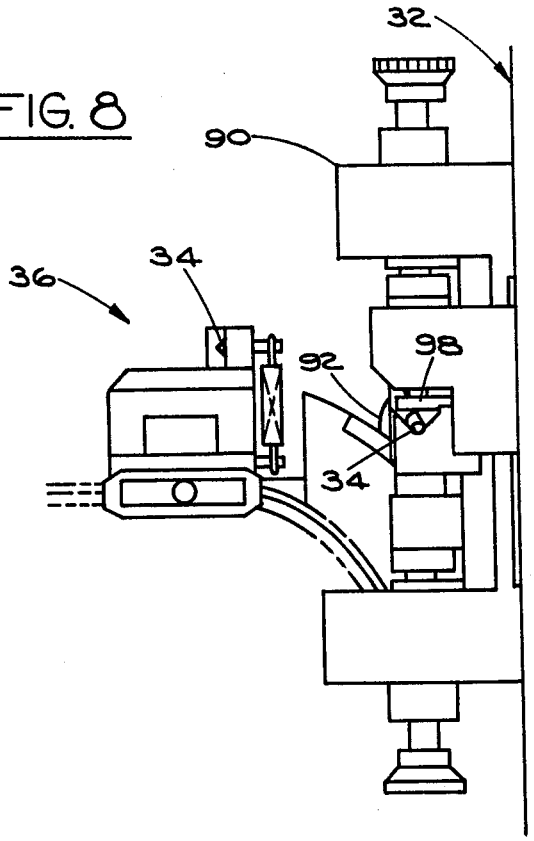
FIG. 8 is a side elevational view of the wire preparation assembly and a portion of the wire transport assembly when in the position illustrated in FIG. 7.
Figure 9:
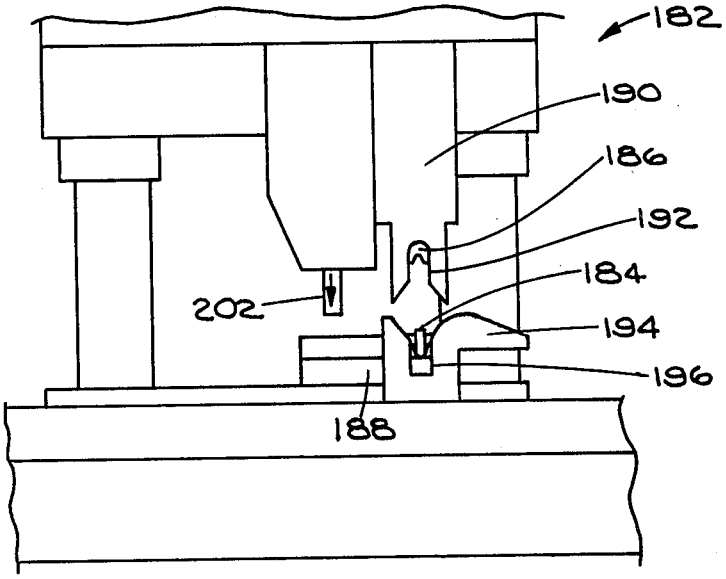
FIG. 9 is a front elevational view of a crimp station comprising a portion of the wire termination assembly of the machine.

More particularly, the cutting and stripping mechanism 90 and the wire gripping fingers 96 and 98 work in the following sequence: A length of wire 34 is fed through the cutting and stripping mechanism 90 and between the open wire gripping fingers 96 and 98 as best shown in FIG. 4. The open fingers 96 and 98 are then moved toward the cutting and stripping mechanism 90 as the movable cutting blades 94 move into engagement with the wire. Shortly thereafter, the fingers 96 and 98 grippingly engage the wire as is shown in FIG. 5. The fingers 96 and 98, which are now in a gripping position, are moved back to their initial position pulling a length of wire 34 from the cutting and stripping mechanism as best shown in FIG. 6. The cutting blades 94 are then moved back to their non-engaging position, the upper finger 98 is opened, and the wire carrier 36 picks up the length of wire 34 at the pickup station 38 as shown in FIGS. 7 and 8.

The length of a given piece of wire is controlled by control boxes 100 and 101. By programming the wire length control 100, a plurality of wire lengths 34 can be provided by the wire preparation assembly 32 having different predetermined lengths which are produced in a known sequence. The wire length control 100 can be programmed by means of a punch tape 102 or other means.

A more detailed description of the wire preparation assembly is disclosed in said U.S. Pat. No. 3,769,681, the contents of which are incorporated by reference herein.

III. WIRE TRANSPORT ASSEMBLY

Figure 2:
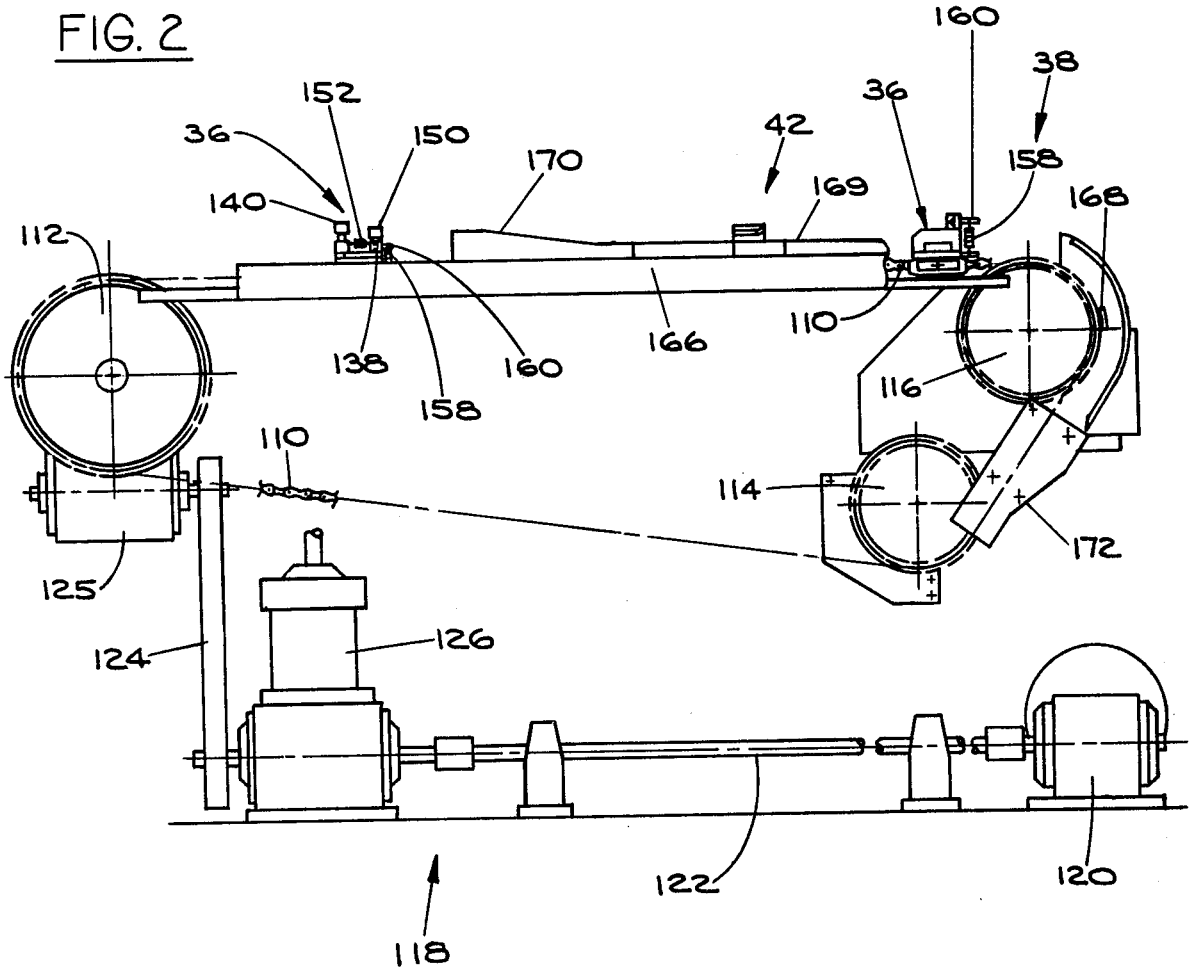
FIG. 2 is an elevational view of the wire transport assembly of the machine of the present invention.
Figure 3:
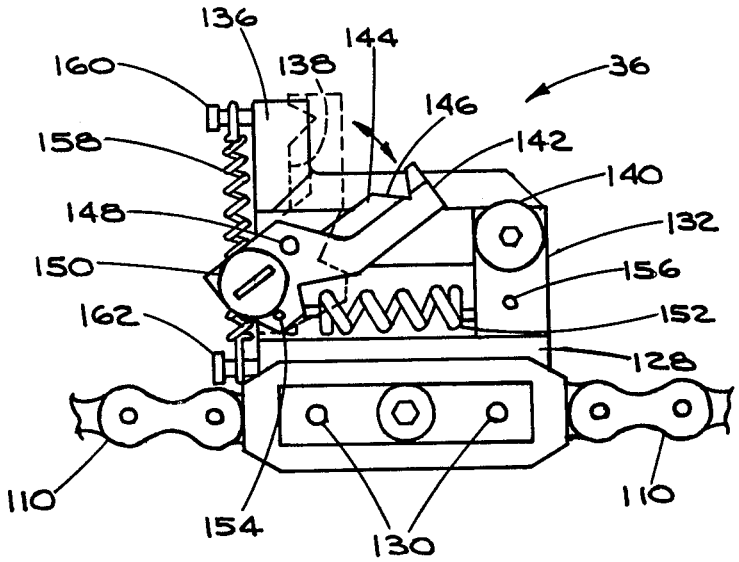
FIG. 3 is an enlarged back elevational view of a wire carrier comprising a portion of the wire transport assembly.
Figure 11:
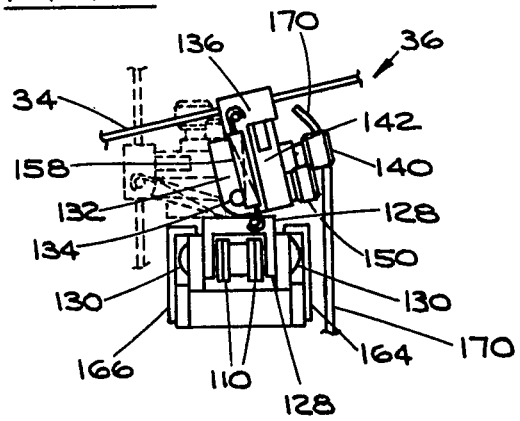
FIG. 11 is a side elevational view showing the wire carrier immediately prior to pivoting and showing the wire carrier in phantom after pivoting.

Turning now to FIGS. 2, 3, and 11, the wire transport assembly will be discussed in greater detail.

The wire carriers 36 are mounted on a chain link conveyor 110. Engaging the chain links 110 are three sprocket gears 112, 114, and 116 (FIG. 2). Gears 112, 114, and 116 are driven by an intermittent drive means generally designated 118. The drive means 118 has an electric motor 120 associated with a drive shaft 122. The drive shaft 122 is connected to a belt 124 to means 125 to drive a portion of machine 30. The drive shaft is also associated with other means 126 to drive other portions of the machine 30. Means 125 and 126 serve to synchronize the actuation of different portions of the machine 30.

Turning now to FIGS. 3 and 11 in particular, the wire carrier 36 is seen to include a base 128 attached between two chain links 110 by means of shafts 130. A carrier body 132 is pivotally mounted on top of the base 128 by means of a hinge 134. The body 132 includes an integral first gripping finger 136 having an elongated channel 138 formed therein. A cam roller 140 is mounted on one side of the wire carrier body 132.

A second gripping finger 142 having an elongated ridge portion 144 adapted to be received in the channel 138 and a V-notch 146 is pivotally mounted with respect to the first gripping finger 136 about a pivot point 148. A second cam roller 150 is mounted on the second gripping finger 142 below the pivot point 148. A wire lead 34 is adapted to be received between the gripping fingers 136 and 142 at the V-notch 146.

A spring 152 is attached between pin 154 formed on the second gripping finger and pin 156 formed on the body 132. Spring 152 serves to keep the gripping fingers 136 and 142 in a normally closed or gripping position.

A second spring 158 is mounted between pin 160 on the body 132 and pin 162 on the base 128. Spring 158 serves to keep the wire carrier body 132 in a normally upright position as depicted in FIGS. 3 and 11 wherein the wire lead 34 is held in a generally horizontal disposition. Spring 158 also serves as an over-center force with respect to the hinge 134 should the wire carrier body 132 be tipped in the direction of the arrow illustrated in FIG. 11. In such a case, spring 158 would keep the wire carrier 32 in a position shown in phantom in FIG. 11 so that a wire lead 34 is held in a substantially vertical position.

The chain conveyor 110 and the mounted wire carriers 36 are held and mounted between a rear vertical conveyor track rail 164 and a front vertical conveyor track rail 166. Rear track rail 164 has cam means formed thereon which are adapted to engage cam roller 150 as the wire carrier 36 travels between the rails 164 and 166.

In particular, when cam roller 150 is engaged, the movable gripping finger 142 is pivoted about point 148 against the force of spring 152 to present the wire carrier 36 in a non-gripping or open position. Thus, looking at FIGS. 2 and 8, when cam means 168 engages cam roller 150, the wire carrier 32 will assume an open position at the pickup station 38 just prior to picking up a wire lead 34 thereat. As the wire carrier 36 passes by the wire pickup station 38, the cam means 168 no longer engages cam roller 150 thereby allowing spring 152 to force the wire carrier back to its normal closed position.

Rear track rail 164 has curved cam portions 169 and 170 (FIGS. 2 and 11) formed at the upper end thereof. The curved cam portion 170 is adapted to engage cam roller 140 to present a pivoting force about the hinge 134. If the distance about which wire carrier body 132 pivots about hinge 134 is great enough, the over-center force of spring 158 will snap the wire carrier body 132 to the position shown in phantom in FIG. 11. This is necessary for reasons which will become more apparent hereinafter.

Cam means 172 is provided to change the wire carrier 32 from the position shown in phantom in FIG. 11 to the normal position shown in FIG. 11. Means 172 merely exerts a pivoting force in the opposite direction to right the wire carrier body 132.

IV. WIRE TERMINATION ASSEMBLY

Turning now to the wire termination assembly, the stations 38, 40, 42, 44 and 46 will be discussed in greater detail. The purpose of the wire termination assembly is to place a terminal on the stripped insulation clad wire lead 34.

As is best shown in FIG. 8, the wire carrier 36 first picks up a wire lead 34 from the wire pickup station 38 in a manner which was discussed before. The wire carrier 36 is then moved by means of the intermittent drive 118 to the insulation strip test station 40.

An insulation strip sensor 180 (FIG. 1) is mounted adjacent station 40 to receive the stripped end of the wire lead 34. The insulation strip sensor 180 inspects the stripped end of the wire 34 to which a terminal will be crimped. This is accomplished by a test of electrical continuity. That is, if, in fact, the insulation has not been stripped off the wire lead 34, the insulation strip sensor 180 will not conduct through that end. On the other hand, if the end of the wire lead 34 is successfully stripped of insulation, the exposed conductor will conduct electricity.

Should the insulation strip sensor 180 sense that insulation has not been stripped from the wire lead 34, a signal will be given to the crimp station 42. Means at the crimp station will inhibit and prevent the crimping of a terminal onto the wire lead 34.

After being tested at the insulation strip station 40, the wire carrier 36 and the held wire lead 34 is moved to the crimp station 42. The crimp station 42 includes a conventional crimp machine 182 for crimping a terminal 184 onto the wire lead 34. The crimp machine 182 is actuated by the intermittent drive 118 so that it is synchronized with the arrival of the wire lead.

As in all conventional crimp machines, this crimp machine 182 includes a punch 186 and an anvil 188 to support the terminal 184. During the actual crimping operation, a wire lead 34 lays within the terminal 184. When the wire carrier 36 is holding the wire in its normal horizontal disposition, the wire 34 will be in the proper crimping position.

A serious problem that is often encountered in performing an automatic crimping operation is to accurately locate the wire lead immediately prior to the crimping operation. Obviously, if the wire lead is bent or it is not straight enough, a faulty crimp or no crimp at all may result.

Figure 10:
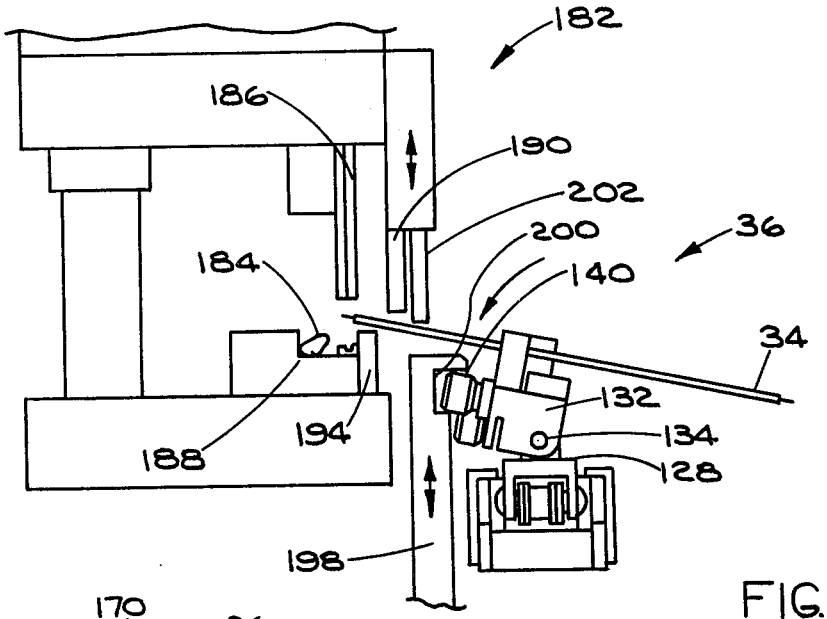
FIG. 10 is a side elevational view of the crimp station with a wire carrier just prior to the crimping operation.

In order to ensure that the wire lead 34 is properly positioned prior to the crimping operation, there is provided an upper wire guide 190 having a wire slot 192 formed therein and a lower wire guide 194 having a slot 196 formed therein. The wire lead 34 is adapted to be received within the slot 196 of the lower wire guide 194. However, as can be seen in FIG. 10, the height of the lower wire guide 194 is greater than the bottom of its slot 196. Accordingly, the wire lead 34 must be carried over the lower wire guide 194 and then down into the slot 196 during the crimping operation.

To this end, a spring loaded deflector is provided on the rear conveyor track rail 164. The deflector 198 has a horizontal channel 200 formed therein to receive cam roller 140. Cam portion 169 serves to guide the wire carrier 36 into the channel 200. The channel 200 holds the wire carrier 36 upwardly so that the wire carrier body 132 pivots with respect to the base 128 thereby causing the held wire lead 34 to tilt somewhat upwardly as is shown in FIG. 10. While in this upward position, the end of the wire lead 34 is able to clear the top of the lower wire guide 194.

When the crimp machine 182 is actuated, the punch 186 and upper wire guide 190 are moved downwardly. In addition, a spring loaded depressor 202 mounted on the crimp machine 182 for movement with the punch 186 will engage the deflector 198. When this occurs, the deflector 198 is moved downwardly against the force of its spring loading, thereby causing the wire carrier body 132 to pivot back to its normal position so that the wire lead 34 is substantially horizontal and received in the bottom of slot 196 of the lower wire guide 194. Also, the upper wire guide will be brought into general engagement with the top of the wire lead 34 during this crimping operation.

The depressor 202 is longer than the punch 186. Thus, the depressor 202 will engage the deflector 198 before the punch 186 crimps the terminal 66. This ensures that the wire lead 34 will be in the correct position before the actual crimping operation.

After completion of the crimping operation, the punch 186, upper wire guide 190 and depressor 202 are raised back to their initial position, thereby allowing the deflector 198 to return to its normal spring-loaded position causing the wire lead 34 and the wire carrier 36 to assume the position generally shown in FIG. 10, except that now a terminal 184 has been crimped onto the end of the wire lead. At this point, the wire transport assembly is reactivated causing the wire carrier 36 and the now terminated wire lead 34 to move on to the terminal test station 44.

The terminal test station has a terminal sensor 204 associated therewith. The terminal sensor 204 senses whether a terminal has been crimped onto the end of the wire lead 34. This test can be performed by means of electrical continuity. That is, the terminal sensor 204 would include two elements or the like (not shown) which would engage a terminal at two points thereof. If no terminal has been crimped onto the wire lead 34, there will be no electrical continuity. Should the absence of a terminal 66 be sensed, a signal is sent to the wire reject station 46 for disposition. In addition, mechanical means may be employed to determine that the terminal 66 that has been crimped is in a proper configuration.

The wire carrier 36 and the terminated wire lead 34 are moved from the terminal test station 44 to the wire reject station 46 after the terminal test has been completed. The wire reject station 46 has a wire reject mechanism 206 associated with the rear conveyor track rail 164 which selectively engages cam roller 150 of the wire carrier 36. Should a signal be received by the wire reject mechanism 206 from the terminal sensor 204, the wire reject mechanism 206 will be actuated to cause the wire carrier to assume its open position, allowing the faulty wire lead 34 to drop out of the wire carrier. In this manner, a faulty wire lead 34 will not be inserted into a connector housing 50.

The wire carrier 36 and the now tested terminated wire lead 34 is moved toward an insertion station 48 for insertion into a connector housing 50 which will be discussed in greater detail hereinafter.

V. HARNESS FABRICATION ASSEMBLY

Turning now to FIGS. 13–18, 22 and 23, the harness fabrication assembly will be described in greater detail.

A wire carrier 36 gripping a tested and terminated wire lead 34 moves from the wire reject station 46 toward the insertion station 48. Between said stations 46 and 48, the wire carrier 36 engages curved cam portion 170 as is best shown in FIG. 11. As already described, the curved cam portion 170 will cause the carrier body 132 to pivot about hinge 134 to the position shown in phantom in FIG. 11. While in this position, the wire lead 34 is substantially vertical, terminal end up, in an insertion position.

The wire carrier 36 stops at the insertion station 48 while in the insertion position. The harness fabrication assembly inserts the terminated wire lead 34 into the corresponding cavity 61 which has been indexed by the housing indexing assembly 52.

Figure 14:
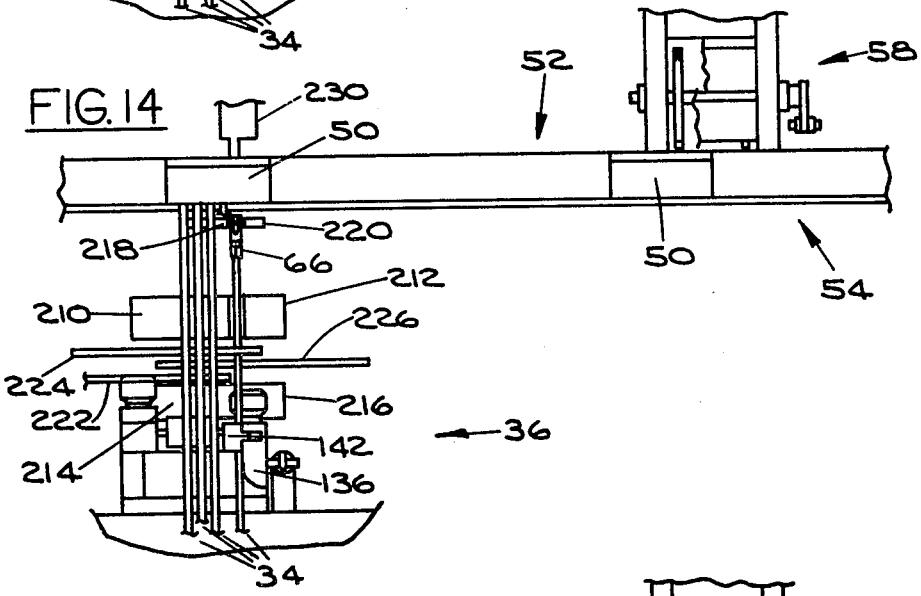
FIG. 14 is a view similar to FIG. 13 with a portion of the housing indexing assembly removed showing the harness fabrication assembly in a "pre-insertion" position.
Figure 15:
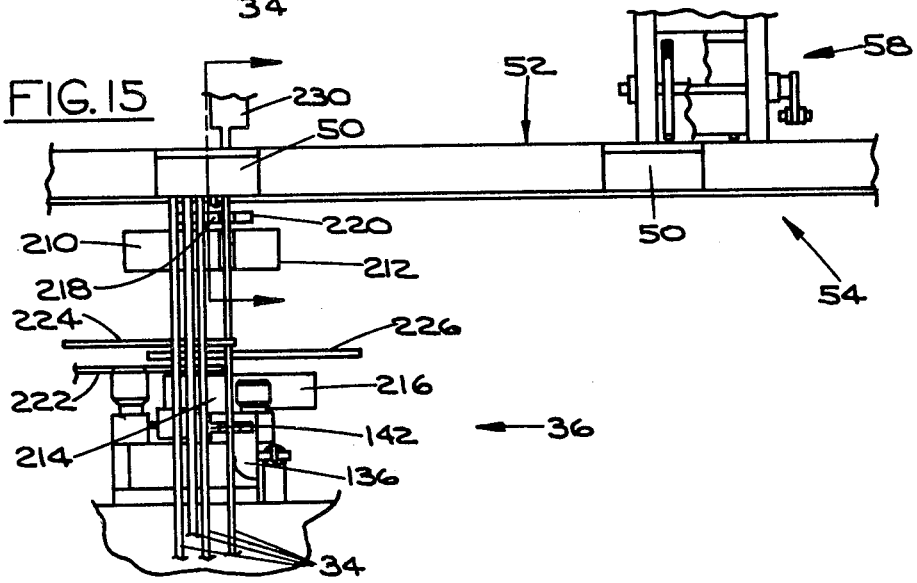
FIG. 15 is a view similar to FIG. 13 with a portion of the housing indexing assembly removed showing the harness fabrication assembly in an "insertion" position.

More particularly, the harness fabrication assembly includes a pair of wire insertion grippers 210 and 212 which are movable in a gripping fashion between an open position and a wire gripping position. Gripper 210 is stationary and gripper 212 is movable with respect to gripper 210. Grippers 210 and 212 are also movable simultaneously up and down between a first position and an insertion position as is shown in FIGS. 14 and 15.

Figure 22:
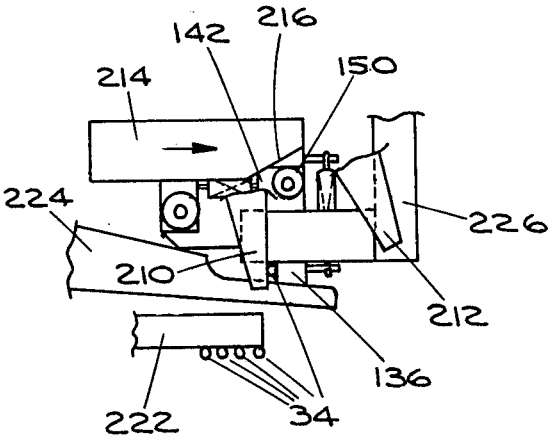
FIG. 22 is a sectional view taken generally along the lines 22—22 of FIG. 13.
Figure 23:
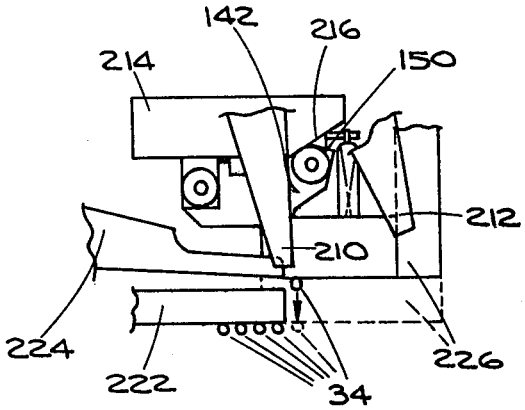
FIG. 23 is a sectional view taken generally along the line 23—23 of FIG. 16.

The harness fabrication assembly also includes a sliding carrier release bar 214 mounted on the rear conveyor rail 164. As is best shown in FIGS. 22 and 23, the release bar 214 has a carrier engaging surface 216 which is adapted to engage cam roller 150 so that the gripping fingers 136 and 142 of the wire carrier 36 will move to an open position. This is required to release the held wire lead 34 to allow the insertion grippers 210 and 212 to insert the wire lead as will be discussed in greater detail hereinafter.

A pair of terminal guide fingers 218 and 220 are provided above the wire insertion grippers 210 and 212. The terminal guide fingers 218 and 220 are movable toward and away from each other and are adapted to engage the terminal 66 immediately prior to grippers 210 and 212 gripping the wire lead 34. This adds extra stability to the terminated wire lead 34 during the insertion operation and positively positions the terminal below the corresponding cavity 61.

In order to prevent previously inserted wire leads 34 from being gripped by accident by the insertion grippers 210 and 212, an escapement mechanism is provided. The escapement mechanism is seen to generally include a stationary restraining bar 222 which holds or restrains the previously inserted wire leads 34 from the insertion station 48 during a successive insertion operation.

The escapement mechanism also includes two movable arms 224 and 226 which guide an incoming wire lead 34 to the insertion station 48 and also push the immediately preceding inserted wire lead out from the insertion station 48 toward the resraining bar 222. Thus, when the housing 50 is indexed, that previously inserted wire will also be restrained by bar 222.

Figure 13:
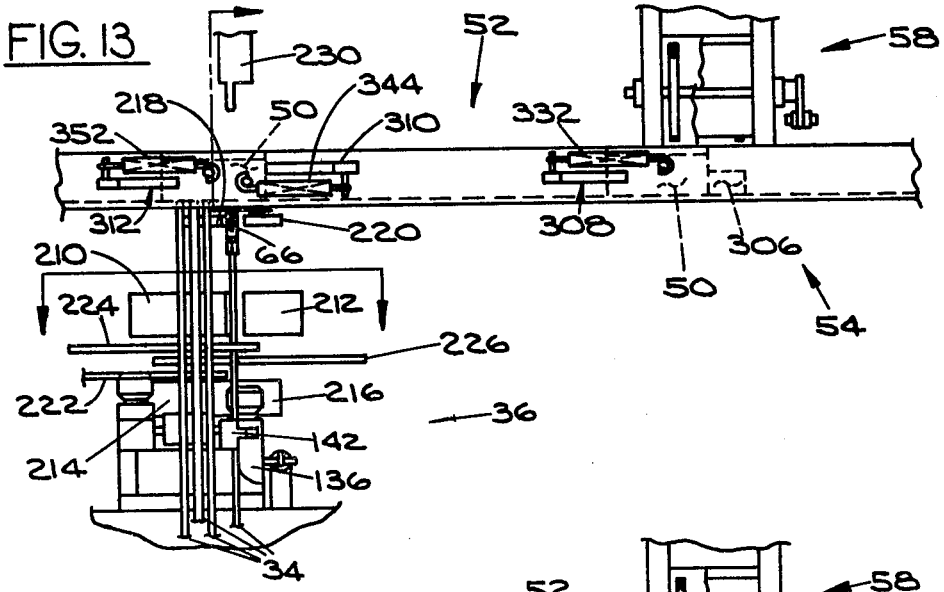
FIG. 13 is an elevational view generally of the harness fabrication assembly of the machine of the present invention including the insertion station, the housing indexing assembly, and the housing feed assembly in an "initial" position for insertion of the next to last wire lead into a housing.

FIGS. 13–16 depict the sequence of operations of the harness fabrication assembly while it is inserting the next to the last wire lead 34 into a housing 50 which has just been indexed to the corresponding cavity 61. More particularly, FIG. 13 shows the arrival of the next to the last wire lead 34 and, for ease of discussion, shall be defined as the "initial" position. In the initial position, wire carrier 36 is in a closed or gripping position, the wire insertion grippers 210 and 212 are open and down, the release bar 214 is not engaging any part of the wire carrier 36, the terminal guide fingers 218 and 220 are spread apart, and the escapement mechanism is in the configuration shown in FIG. 22. As is seen in FIG. 22, the arriving wire is guided between arms 224 and 226 whereas the remaining previously inserted wire leads are being restrained by the restraining bar 222.

After the initial position, the harness fabrication assembly assumes a "pre-insertion" position which is illustrated in FIG. 14. In the preinsertion position, the wire insertion grippers 210 and 212 have closed to grip the next to last wire lead 34 and the terminal guide fingers 218 and 220 have closed about the terminal 66. The wire lead 34 is now in a position to be inserted into the housing 50.

The harness fabrication assembly then assumes an "insertion" position as illustrated in FIG. 15. Between the pre-insertion position and the insertion position, carrier release bar 214 has been moved over so that it opens the wire carrier 36 thereby releasing the wire lead 34, and the closed wire insertion grippers 210 and 212 have moved upwardly to push the terminal 66 into its corresponding cavity 61.

Figure 16:
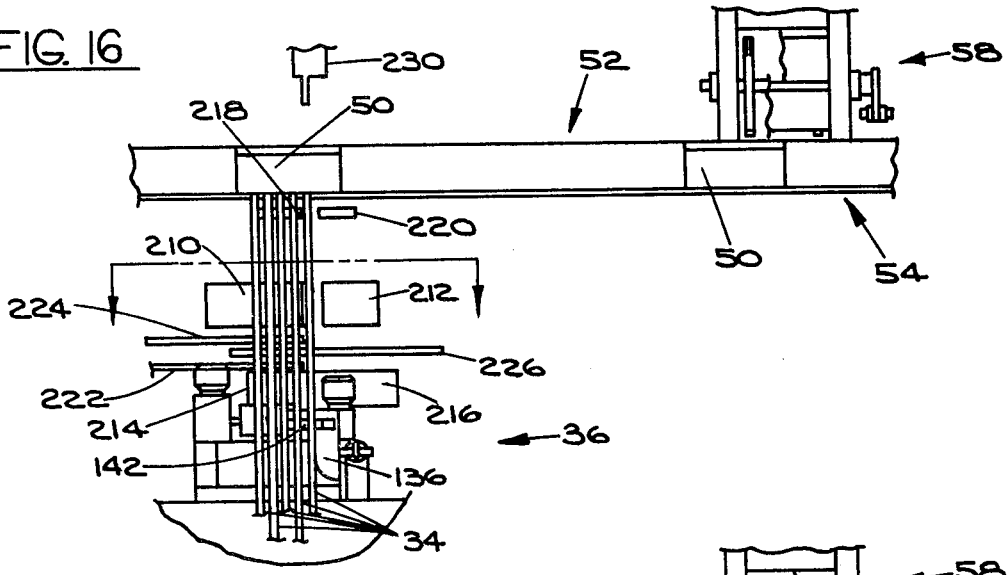
FIG. 16 is a view similar to FIG. 13 with a portion of the housing indexing assembly removed showing the harness fabrication assembly in a "post-insertion" position.

After the insertion position, the harness fabrication assembly moves to a "post-insertion" position as illustrated in FIG. 16. Between the insertion position and the post-insertion position, the wire insertion grippers 210 and 212 have opened and moved down, the terminal guide fingers 218 and 220 have opened and the escapement mechanism has assumed the position as best shown in FIG. 23. As seen in FIG. 23, the arm 226 engages the just inserted wire lead 34 and moves it outwardly a distance equal to the other previously inserted wire leads as is shown in phantom.

Figure 17:
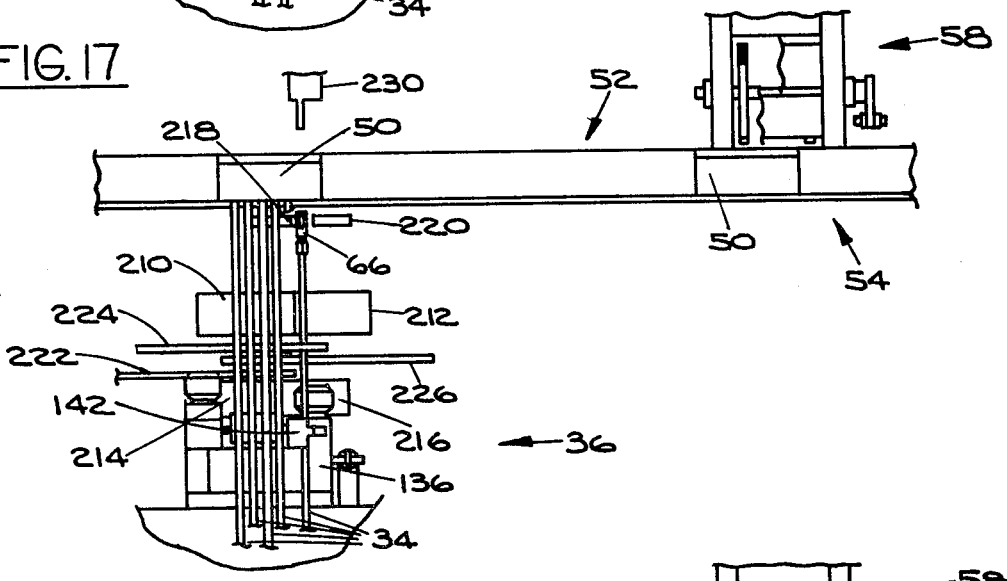
FIG. 17 is a view similar to FIG. 13 with a portion of the housing indexing assembly removed showing the harness fabrication assembly in the "initial" position for insertion of the last wire lead into a housing.

FIG. 17 depicts the harness fabrication assembly in an "initial" position as that of FIG. 13, except that the housing 50 has been indexed over one terminal cavity 61 preparatory to the next insertion operation. When the housing 50 is thus indexed, it can be appreciated by looking at the phantom of FIG. 23 that the just inserted wire lead 34 will likewise be moved so that it will be restrained by restraining bar 222.

Figure 18:
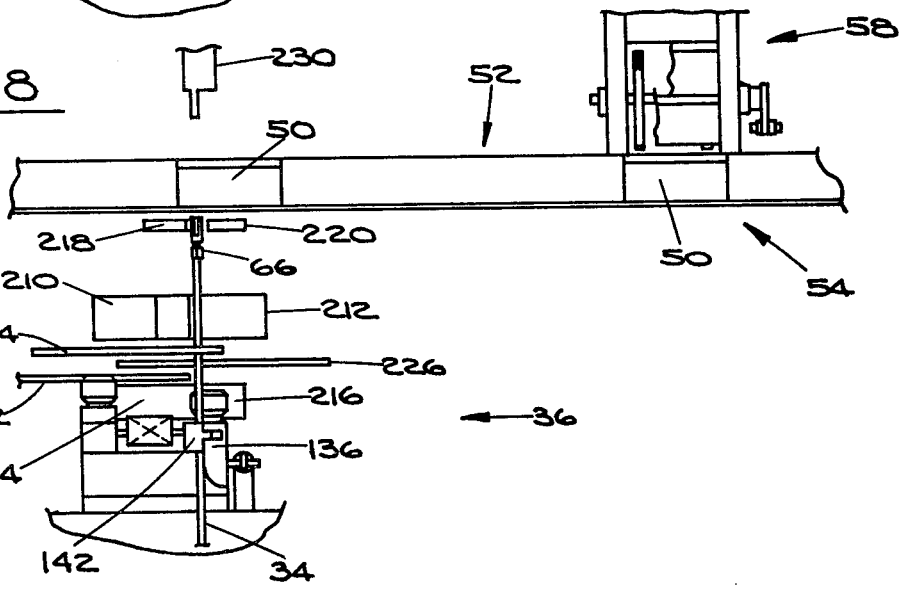
FIG. 18 is a view similar to FIG. 13 with a portion of the housing indexing assembly removed showing the harness fabrication assembly in the "initial" position for insertion of the first wire lead into a housing.

The above sequence defining an insertion operation is repeated for each wire lead. After the insertion of the last wire lead, the housing 50 that was at the housing load station 54 is moved to the insertion station 48 and the harness fabrication assembly assumes the "initial" position for the insertion of the first wire lead as is best shown in FIG. 18.

VI. HARNESS TEST ASSEMBLY

Figure 19:
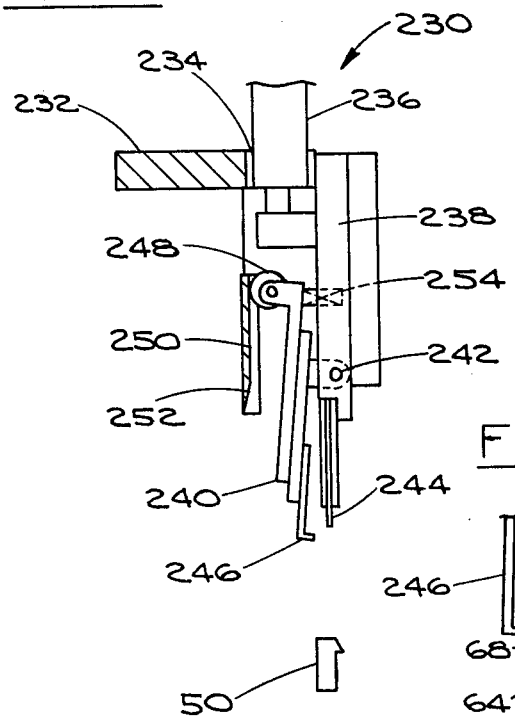
FIG. 19 is a side elevational view of a probe assembly comprising part of the harness test assembly in its initial, non-testing position.
Figure 20:
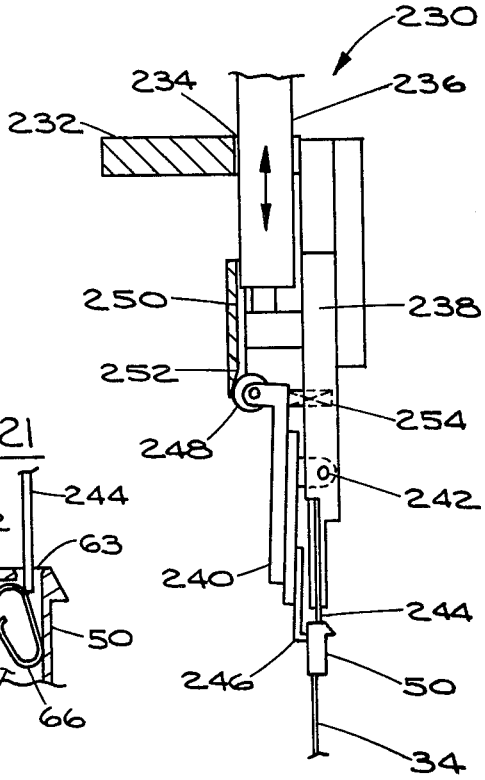
FIG. 20 is a side elevational view of the probe assembly after it has been moved to its testing position.

In order to ensure that the terminated wire leads 34 have been properly inserted into their corresponding cavities 61, a harness test assembly is provided. As is best seen in FIGS. 19–21, the harness test assembly generally includes a probe assembly, generally designated 230, associated with the insertion station 48. The probe assembly 230 performs an electrical continuity check to determine if a terminal 66 is fully seated in the cavity 61 of the connector housing 50. In addition to this inspection test, the probe assembly 230 during its downward travel, positions the connector housing 50 to an exact location prior to the insertion operation.

The probe assembly 230 is seen to be mounted on a horizontal support wall 232. An opening 234 is formed in wall 232 to allow a piston member 236 to be reciprocally received therethrough. Piston member 236 is operably connected at one end to a drive mechanism (not shown).

The piston is secured to one jaw-like member 238. Another jaw-like member 240 is pivotally mounted to the first jaw member 238 about a pivot point 242.

A vertical test element 244 extends from the jaw member 238 and is adapted to be received through the top opening 63 of the cavity 61 at the insertion station 48. A side test element 246 extends from the jaw member 240 and is adapted to be generally received within the slot 62 of the corresponding cavity 61 at the insertion station 48.

The jaw member 240 has a cam roller secured thereto which is adapted to roll against a vertical surface 250 having a taper 252 at the bottom thereof. A spring 254 is mounted between jaw members 238 and 240 above the pivot point 242. The force of spring 254 tends to bias the test elements 244 and 246 together. However, because the roller 248 rollingly engages surface 250, the test elements 244 and 246 are normally spaced apart, as is best shown in FIG. 19.

When the probe assembly 230 is lowered by moving the piston member 236 downwardly, the roller 248 engages the tapered portion 252 of surface 250 thereby allowing spring 254 to bring test elements 244 and 246 closer together.

In operation, the probe assembly 230 is in the position as shown in FIG. 19 when the harness fabrication assembly is in its initial position as shown in FIG. 13. When the harness fabrication assembly is moved to its pre-insertion position as shown in FIG. 14, the probe assembly 230 is lowered. At the pre-insertion position, the top test element 244 is inserted through the top opening 63 and further aligns the corresponding cavity 61 with the wire lead 34 that is ready to be inserted at the insertion station 48.

When the harness fabrication assembly assumes the insertion position as shown in FIG. 15, the probe assembly 230 assumes the position as shown in FIGS. 20 and 21. The test elements 244 and 246 are now brought closer together in the manner set forth above. If the terminal 66 has been properly inserted, the top test element will engage one portion of the terminal 66 whereas the side test element 246 will engage another portion of the terminal 66 through the slot 62.

More particularly, the side test element 246 will engage the locking tang 68. If the terminal 66 is not inserted, the locking tang will not be received in slot 62. Therefore, electrical continuity between test elements 244 and 246 will not be effected. The probe assembly 230 returns back to the position shown in FIG. 19 when the harness fabrication assembly assumes its post-insertion position.

As has already been indicated, after a harness assembly 60 has been completed, it is moved from the insertion station 48 to the eject station 56. The eject station 56 has a gate means 256 for directing an ejected connector housing into either a "good" box or a "bad" box. The gate means 256 is operably associated with the probe assembly 230 so that the gate means 256 normally directs the completed harness assembly 60 into a good box. However, should the gate means 256 receive a signal from probe assembly 230 that there is a bad insertion, the gate means 256 will direct the completed harness assembly 60 into the bad box. This virtually eliminates the necessity of having a quality checker present as has been the case in the past.

VII. HOUSING INDEXING ASSEMBLY

Between each insertion operation by the harness fabrication assembly, the housing indexing assembly 52 moves the housing 50 so that the next corresponding cavity 61 is presented at the insertion station 48. In addition, the housing indexing assembly 52 transports housings 50 from the housing load station 54 to the insertion station 48 and transports a completed harness assembly 60 from the insertion station 48 to the eject station 56.

Turning now to FIGS. 13 and 24–27, the housing indexing assembly 52 will be discussed in greater detail. The housing indexing assembly 52 is seen to generally include a stationary rail 260 mounted on the machine 30 and a parallel spaced apart longitudinally movable indexing rail 262 mounted to an actuating mechanism (not shown). Indexing rail 262 is movable longitudinally in reciprocal fashion and parallel to rail 260.

Each rail 260 and 262 has indentical horizontal housing support lips 266 and 268 respectively extending toward each other from the bottom thereof. The rails 260 and 262 are spaced a distance apart to accomodate the width of a connector housing 50 therebetween so that the support lips 266 and 268 prevent the housing 50 from falling between rails 260 and 262.

The stationary rail 260 includes two substantially identical indexing tabs 270 and 272 each mounted in its own opening 274 and 276 respectively, formed in rail 260. Each tab 270 and 272 are rotatably mounted within openings 274 and 276 respectively about a pivot point 278 and 280 respectively. Each opening 274 and 276 has a stop shoulder 282 and 284 respectively formed therein.

Each indexing tab 270 and 272 includes a generally perpendicular housing engaging surface 286 and 288 respectively extending out of opening 274 and 276 respectively. In addition, each indexing tab 270 and 272 includes a tapered housing engaging surface 290 and 292 respectively also extending out of opening 274 and 276 respectively. A stop portion 294 and 296 are formed on each indexing tab 270 and 272 respectively and are adapted to engage stop shoulder 282 and 284 respectively. Each indexing tab 270 and 272 includes a portion 298 and 300 respectively extending out of opening 274 and 276 respectively which is attached to rail 260 by means of a spring 302 and 304 respectively. Springs 302 and 304 biases their respective indexing tabs 270 and 272 in the normal positions shown in FIGS. 24–27.

Movable indexing rail 262 is seen to generally include a pushing tab 306 extending inwardly and secured to the rail 262 and three indexing tabs, 308, 310 and 312. Each indexing tab 308, 310 and 312 is pivotally mounted within an opening 314, 316 and 318 respectively formed in rail 262 about a pivot point 320, 322, and 324 respectively.

Indexing tab 308 has forward and rearward tapered housing engaging surfaces 326 and 328 respectively extending inwardly toward rail 260 outside of opening 314. Indexing tab 308 also has a portion 330 secured to rail 262 by means of a spring 332 which serves to bias indexing tab 308 in the position shown in FIGS. 24–27.

Indexing tab 310 includes a stop portion 334 which is adapted to engage against a stop shoulder 336 formed in opening 316. Indexing tab 310 includes a generally perpendicular housing engaging surface 338 and a tapered housing engaging surface 340 extending out of opening 316 toward rail 260. A portion 342 of indexing tab 310 is attached to the indexing rail 262 by means of a spring 344 which serves to bias the indexing tab 310 in the position shown in FIGS. 24–27.

Indexing tab 312 includes forward and rearward tapered housing engaging surfaces 346 and 348 extending out of opening 318 toward the stationary rail 260. Indexing tab 312 has a portion 350 extending out of opening 318 which is attached to the indexing rail 262 by means of a spring 352 to bias the indexing tab 312 in the position shown in FIGS. 24–27.

Turning now to FIGS. 24–27 in greater detail, the sequence and operation of the housing indexing assembly 52 is illustrated. For ease of discussion, the housings 50 and/or harnesses 60, will be referenced by A, B, C and D rather than the ordinary reference numerals.

Figure 24:
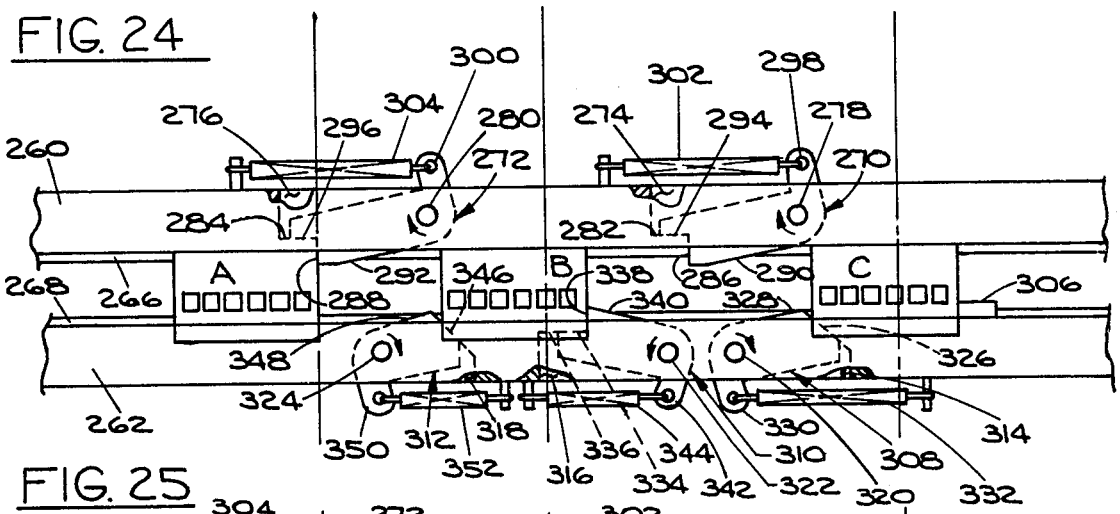
FIG. 24 is a top plan fragmentary view of the housing indexing assembly of the present invention during the insertion of the next to last wire lead into a housing.

Turning now to FIG. 24, the housing indexing assembly 52 is shown in the position wherein the next to last wire lead is being inserted into the housing B at the insertion station 48. At this position as shown in FIG. 24, surface 288 of indexing tab 272 engages completed harness A at the eject station 56, housing B is nested between surfaces 338 and 346 of indexing tabs 310 and 312, respectively; and housing C is nested between pushing tab 306 and surface 326 of indexing tab 308 at the housing load station 54.

Figure 25:
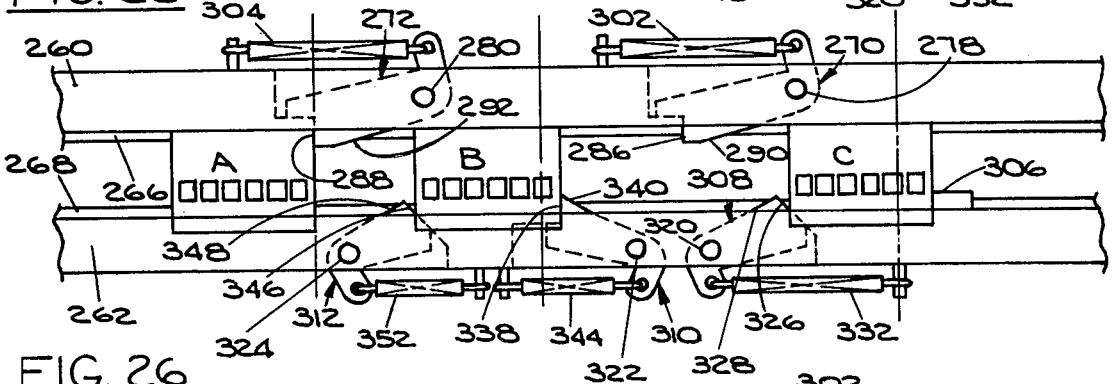
FIG. 25 is a top plan fragmentary view of the housing indexing assembly of the present invention during the insertion of the last wire lead into a housing to form a completed connector harness.

FIG. 25 shows the position of the housing indexing assembly 52 during the insertion of the last wire lead. The only difference between the position shown in FIG. 25 and the position shown in FIG. 24 above is that rail 262 has been moved a small increment to the left so that the next terminal receiving cavity 61 is correctly located at the insertion station 48. When indexing rail 262 is moved, the housings B and C are all moved a like distance and are pushed by surfaces 338 and 306, respectively. Housing A does not move and remains adjacent surface 288.

After the insertion of the last wire lead 34, the housing indexing assembly 52 must now move housing C from the housing load station 54 to the insertion station 48 and, simultaneously, move completed harness B from the insertion station 48 to the eject station 46 and then eject housing A to the gate means 256. Looking at FIG. 26, this is accomplished by the movement of the indexing rail 262 a relatively large distance to the left. When this occurs, pushing tab 306 has pushed housing C past surface 290 of indexing tab 270 and surface 338 pushes housing B over and past surface 292 of indexing tab 272. During this process, indexing tabs 270 and 272 had pivoted about their respective points 278 and 280. Immediately thereafter, springs 302 and 304 return indexing tabs 270 and 272 back to their original positions. When housing B reaches the eject station 56, it abuts housing A and pushes it outwardly toward the gate means 256.

Figure 26:
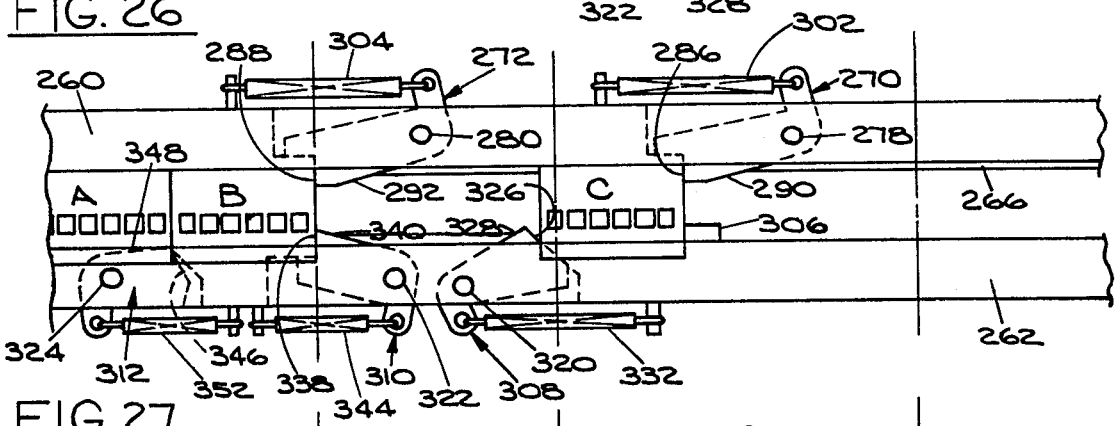
FIG. 26 is a top plan fragmentary view of the housing indexing assembly of the present invention immediately after movement of a completed harness to the eject station and a new housing to the insertion station.
Figure 27:
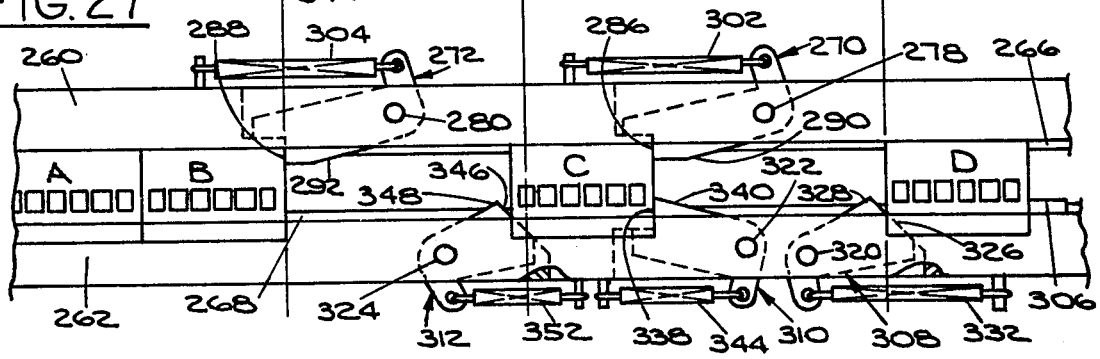
FIG. 27 is a top plan fragmentary view of the housing indexing assembly of the present invention during the insertion of the first wire lead into a housing.

After the indexing assembly has moved housings A, B and C as above described and shown in FIG. 26, the rail 262 is moved back to the right to its initial position and a new housing D is fed to the housing load station 54 as is shown in FIG. 27. The indexing rail 262 is allowed to return back to its initial position because surfaces 288 and 286 of indexing tabs 272 and 270 hold housings B and C at the eject station 56 and the insertion station 48 respectively. Surfaces 326 and 340 of indexing tabs 308 and 310 engage housing C as the indexing rail 262 is moved from the position shown in FIG. 26 to the position shown in FIG. 27. In addition, surface 346 of indexing tab 312 engages housing B during the movement of rail 262. This is effected due to the pivoting of indexing tabs 308, 310 and 312 about their respective points 320, 322 and 324. Springs 332, 344 and 352 causes indexing tabs 308, 310 and 312, respectively, to return back to their initial positions. When in the position shown in FIG. 27, the housing feed assembly 58 is actuated in a manner to be discussed in greater detail hereinafter and a new housing D is allowed to be received at the housing load station 54.

It is understood that by merely changing the relative distances and spacial relationships between indexing tabs 270, 272, 308, 310, 312 and 306, the housing indexing assembly 52 can be made to accept any size connector housing 50 therein.

VIII. HOUSING FEED ASSEMBLY

Figure 28:
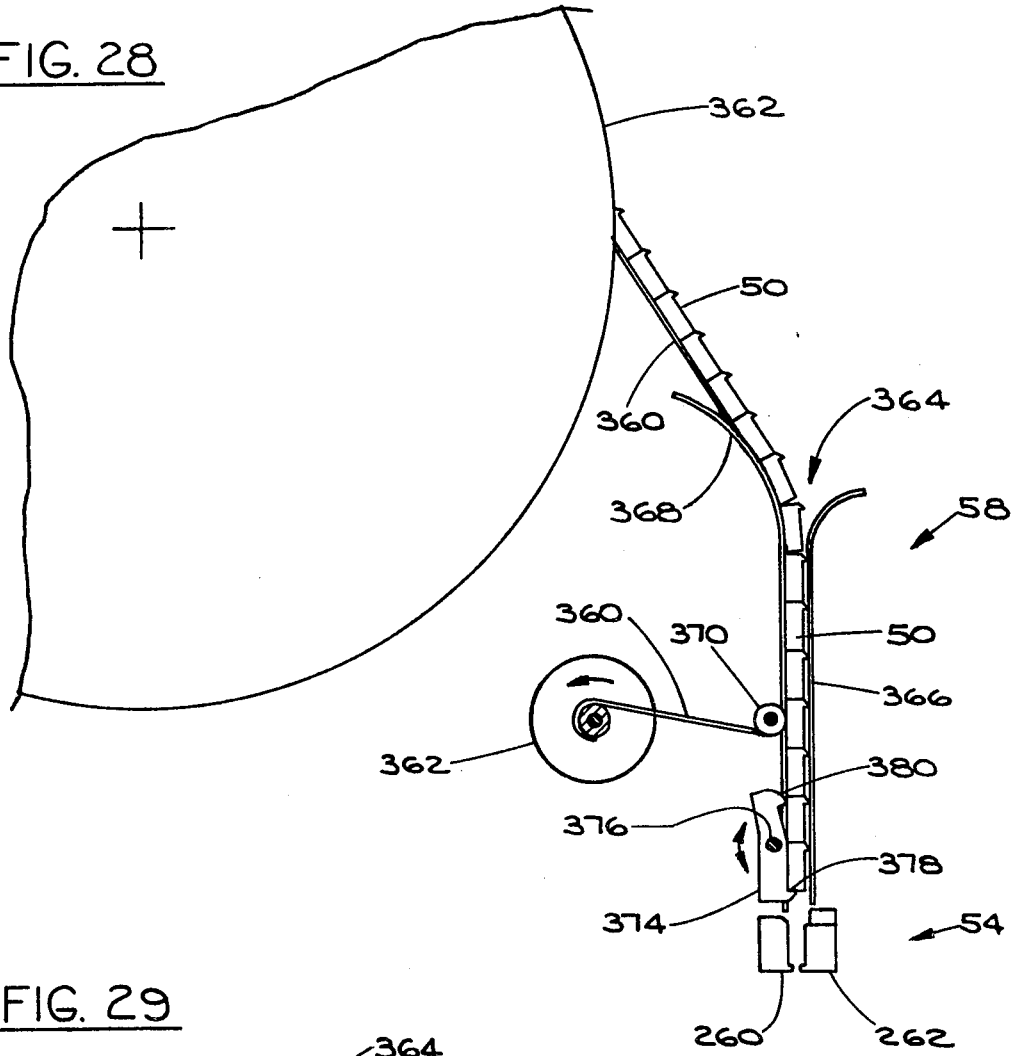
FIG. 28 is a fragmentary side elevational view of the housing feed assembly immediately before feeding a new housing to the housing load station.
Figure 29:
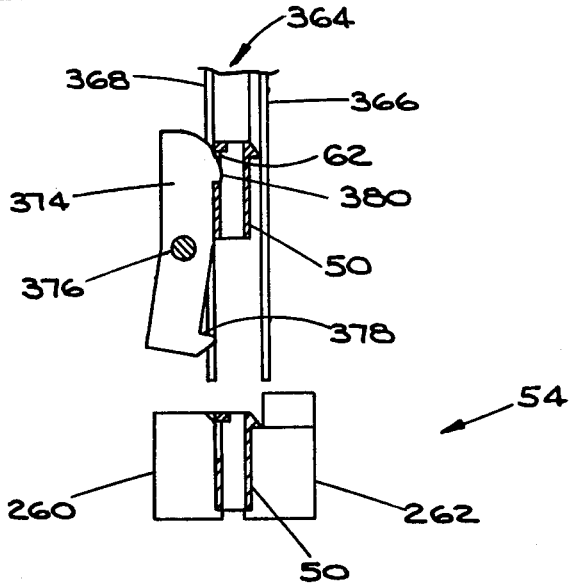
FIG. 29 is an enlarged fragmentary side sectional view of a portion of the housing feed assembly immediately after feeding a new housing to the housing load station.

Turning now to FIGS. 28 and 29, the housing feed assembly 58 will be discussed in greater detail.

The housings 50 are provided on a tape 360 having a pressure sensitive adhesive on one side thereof and are wound on a reel 362 adjacent a chute funnel opening, generally designated 364. The chute generally includes a pair of spaced apart channel-shaped members 366 and 368. The housings 50 are adapted to the received between the members 366 and 368.

The housings 50 are directed from the reel 362 down the chute funnel opening 364 and then the tape 360 is removed and engages a roller 370 midway down. From the roller 370 the tape only is wound about a tape takup reel 372 which is operably associated with suitable drive means (not shown). Accordingly, all the housings 50 which are in the chute 364 below roller 370 are already removed from the tape 360.

A gate member 374 is pivotally mounted adjacent the chute 364 near the bottom thereof on a shaft 376. The purpose of the gate member is to prevent a free housing 50 from falling to the housing load station 54 by gravity before the housing indexing assembly 52 is prepared to pick up a new housing.

More particularly, the gate member 374 has a bottom support ledge 378 which is adapted to engage and support the bottom of a housing 50 as is best shown in FIG. 28. A protrusion 380 is formed at the top of the gate member 374 and is adapted to be received into a housing slot 62 after the gate member 374 is pivoted as is best shown in FIG. 29.

In operation, the housing feed assembly 58 is inactive until the housing at the housing load station 54 is moved to the insertion station 48. Before that occurs, the housing feed assembly 58 is in the position shown in FIG. 28 wherein the support ledge 378 prevents the housings 50 from dropping into the housing load station 54.

When the housing previously at the load station 54 has been moved to the insertion station 48 and the housing indexing assembly 52 has assumed the position shown in FIG. 27, the gate member 374 is pivoted about shaft 376 so that the housing previously supported by ledge 378 is allowed to drop in the housing load station 54 between tab 306 and surface 326 of indexing tab 308, (FIG. 27). The next housing is prevented from dropping into the housing load station 54 by virtue of the reception of the protrusion 380 of the gate member 374 into the slot 62 of the housing as shown in FIG. 29.

After a housing 50 has been successfully fed to the housing load station 54, the gate member 374 is pivoted back to its original position allowing the housing previously held by the protrusion 380 to drop down and be supported by ledge 378 as shown in FIG. 28.

It is to be noted that a housing cannot be successfully fed to the housing load station 54 until the indexing rail 262 comes all the way back to its initial position as shown in FIG. 27. Only in this position does the space between the pushing tab 306 and surface 326 align between the channel members 366 and 368.

IX. OPERATION

In operation, the first thing that must be determined is the length of wire required, the length of the insulation strip, and which wire lead 34 is desired to be inserted into which terminal cavity 61. Once this is decided, the wire preparation assembly 32 can be programmed by means of the punch tape 102 to provide the desired sequence of wire leads 34.

The next thing to be determined is the type of terminal 66 to be crimped onto the stripped wire lead 34. Once this decision is made, the desired crimp die (not numbered) and terminals are supplied to the crimping machine 182.

The next thing to be decided is the type of housing 50 to be fed to the insertion station 48. Once this is decided, the proper spacial relationship between the indexing tabs 270, 272, 306, 308, 310 and 312 can be effected. In addition, the indexing distance between insertions is adjusted so that the means which actuate the housing indexing assembly 52 will move the rail 262 the correct distance each time a wire has been inserted. It is understood that not only is the housing indexing assembly 52 capable of linearly moving a housing 50, but it is also capable of indexing a housing having a X-Y Matrix of terminal cavities 62 as is disclosed in the aforementioned Patent application Ser. No. 538,188, the contents of which are incorporated by reference herein.

Depending on the type of housing 50 and terminal 66 which is employed, the test elements 244 and 246 of the probe assembly 230 may be changed somewhat to fit any particular configuration.

The machine 30 is now ready to perform the operations already described in this application. By using this machine 30, the cost of assembly labor is greatly reduced, if not entirely eliminated in some cases.

We claim:

1. In a wire handling and fabrication machine including wire preparation means for presenting an insulation clad wire cut and stripped in a predetermined manner at a wire pickup station, a crimp station having a plurality of terminals and means for crimping a terminal onto a wire, a wire carrier for holding a wire, and intermittent drive means associated with said wire carrier for moving said wire between said stations, the improvement comprising:

wire guide means at said crimp station and associated with said crimping means, said wire guide means including a slot open at the top to receive and align the wire lead at the crimp station;

said wire carrier including means for pivoting said carrier between a first position wherein a wire lead is in an upwardly slanted position over said slot and a second position wherein said wire lead is in a substantially horizontal position; and movable carrier deflector means associated with said crimping means for engaging said wire carrier and moving said wire carrier between its first position and its second position so that the wire lead is moved into and out of said slot.

2. The machine of claim 1 wherein said deflector means includes means mounting said deflector means for movement between a normal position and a depressed position and spring means to bias said deflector means in its normal position, said crimping means including a depressor for engaging the deflector means and moving said deflector means to its depressed position whenever the crimping means is actuated.

* * * * *